US005482272A

United States Patent [19]

Hylak et al.

[11] Patent Number: 5,482,272

[45] Date of Patent: Jan. 9, 1996

[54] BALL CUP FOR TABLE SOCCER GAME

[75] Inventors: Peter J. Hylak, Northbrook; Gary Berge, Crystal Lake, both of Ill.

[73] Assignee: E & H Plastics Co., Inc., Chicago, Ill.

[21] Appl. No.: 348,729

[22] Filed: Dec. 2, 1994

[51] Int. Cl.[6] ..... A63F 7/06

[52] U.S. Cl. ..... 273/85 D

[58] Field of Search ..... 273/94, 85 A, 273/85 B, 85 C, 85 D

[56] References Cited

U.S. PATENT DOCUMENTS 3,653,661 4/1972 Leonart ..... 273/85 D 3,870,303 3/1975 Patterson, Jr. ..... 273/85 D 4,078,797 3/1978 Bergee ..... 273/85 D

*Primary Examiner*—William H. Grieb

*Attorney, Agent, or Firm*—Wallenstein & Wagner, Ltd.

[57] ABSTRACT

The invention is directed to a table game, such as table soccer that includes a unitary ball cup. The unitary ball cup includes a quarter-sphere receiving structure, a flange and barbed tangs for releasably securing the ball cup to the game table. The function of the unitary ball cup is to put a game ball into play. The invention also enhances the aesthetics of the game table, and eases installation and assembly.

26 Claims, 1 Drawing Sheet

BALL CUP FOR TABLE SOCCER GAME

BACKGROUND OF THE INVENTION

Table soccer games are generally known in the recreational games art. Such games usually involve manually operated players that simulate field hockey, soccer or the like. The game is usually played by two opposing persons who operate the players.

A plastic ball or sphere is employed in the game. The ball is put into play by dropping the ball into the device shown in FIG. 1, labeled "PRIOR ART" (hereafter "prior ball cup"). The prior ball cup was secured to the side wall of the table game by dispensing screws through holes located on its flange. Although the prior ball cup transferred the ball into play, it has several drawbacks.

One major drawback of the prior cup is that it is cumbersome. To install the prior cup, three or more screws are necessary to secure the cup to the table game. Screws may be lost or misplaced during transportation of the unassembled game table, causing customer frustration and dissatisfaction. The consumer or manufacturer may also have to drill pilot holes for the screws.

The prior ball cup is also cumbersome, due to the inability to efficiently package a table with an installed ball cup. If the cup were to be installed by the manufacturer, a wider box would be necessary to accommodate the secured ball cup, as that cup would project from the side of the table.

Another major drawback of the prior ball cup is that it is aesthetically unappealing. The heads of the screws are in plain view and the flange covers only 180°. In addition, the circular cutout portion of the table wall through which the ball passes to reach the table surface is open to view. The hole or cutout is visually unappealing and appears unfinished because most table walls are constructed of veneer particle board.

The present invention solves the problems associated with the prior ball cups. The present invention also overcomes the drawbacks of the prior ball cups. These and other aspects of the invention are set forth below.

SUMMARY OF THE INVENTION

The present invention is directed to a table game, such as table soccer, that includes a unitary ball cup. Table soccer games are known in the art as shown in the products catalog entitled "THE FUN BEGINS WITH RECREATIONAL PRODUCTS MFG. INC." The pages entitled "WORLD CHAMPIONSHIP SOCCER GAME" showing Model #25008 and "DEVONSHIRE SOCCER GAME" showing Model #25008E0 illustrate table games known in the art.

One aspect of the present invention is a unitary ball cup comprising a means for receiving a spherical ball, a flange, and a means for releasably securing the ball cup to the table game. By "unitary" it is meant that the ball cup is a unit having the indivisible character of a unit or a whole.

The means for receiving the spherical ball is a unitary structure capable of receiving a spherical ball and transferring the ball to a playing surface on the game table. The means for receiving includes any equivalent structure capable of transferring the ball to the playing surface. Preferably, the means for receiving is a structure in the shape of a quarter-sphere. The means for receiving may also be a channel. Most preferably, the means for receiving is a combination of a quarter-sphere and channel structure.

The flange is a unitary structure capable of preventing the ball cup from being pushed entirely through the side wall of the game table toward the playing surface. The flange includes any equivalent structure capable of such prevention. Preferably, the flange is circular in shape. Most preferably, the flange is a full 360°, flat and circular.

The means for releasably securing the ball cup to the table game is a unitary structure (1) capable of securing the ball cup to the side wall of the table game, and (2) capable of releasing the ball cup from the side wall. The means for releasably securing also includes equivalent unitary structures known in the art that are capable of securing the ball cup to the side wall of the table game and capable of releasing the ball cup from the side wall. The means for releasably securing does not, however, include non-unitary structures, such as screws, nails, rivets or like structures, known in the art. Preferably, the means for releasably securing is one or more, preferably two, resilient latches, hooks or barbed tangs.

Optionally, the ball cup may further include a means for preventing the ball cup from rotating when it is releasably secured to the table game. The means for preventing rotation includes any unitary device, structure or composition capable of preventing the ball cup from rotating when releasably secured to the side wall. Preferably, the means for preventing the ball cup from rotating is a unitary key structure adapted for a keyway. The key and keyway structures are capable of preventing the ball cup from rotating when secured to the table game. The keyway is to be located in a cutout portion of the table wall.

Preferably, the ball cup further includes a unitary annular sleeve. When secured to the side wall, the annular sleeve rests against the cutout portion of the table wall, and provides the side wall and cutout portion with a finished appearance.

The unitary ball cup of the present invention may be made from suitable materials of construction known in the art.

DETAILED DESCRIPTION OF THE PREFERRED EMBODIMENT

Figure 1:
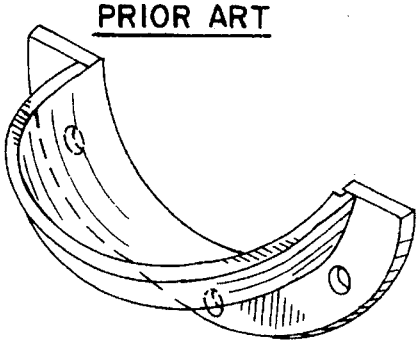
FIG. 1 PRIOR ART
FIG. 1 is a top-front perspective view of the prior art ball cup.
Figure 2:
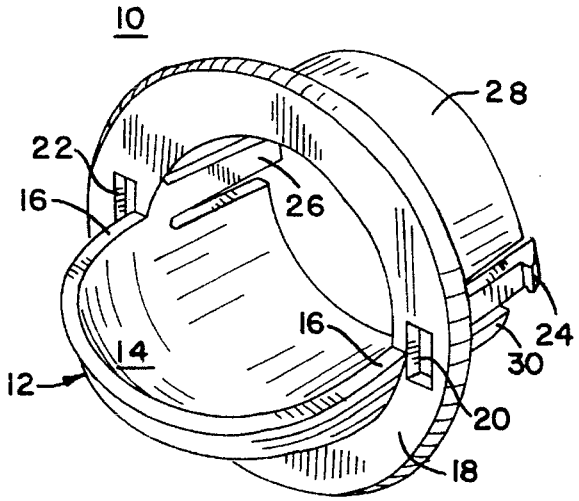
FIG. 2 is a top-front perspective view of the ball cup of the present invention.
Figure 3:
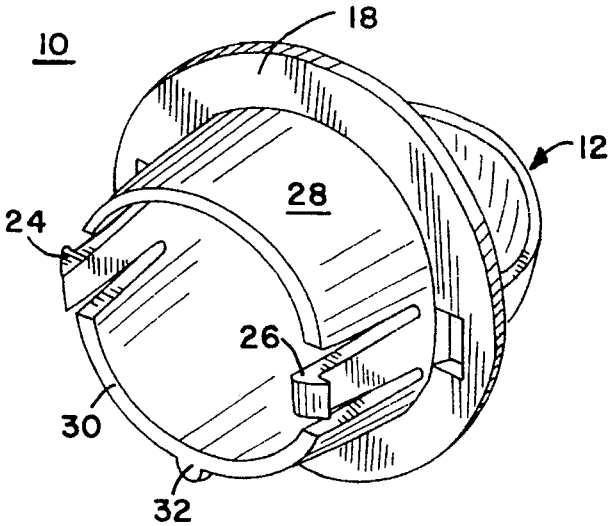
FIG. 3 is a top-rear perspective view of the ball cup of the present invention.
Figure 4:
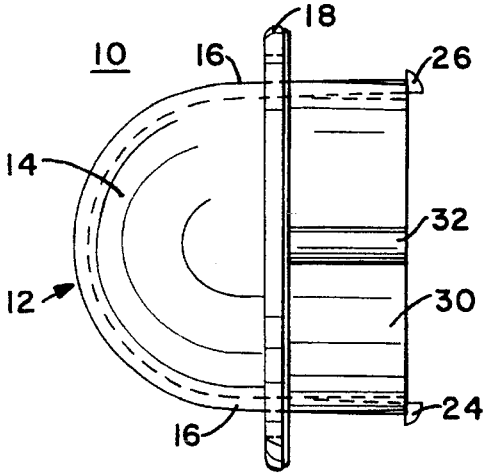
FIG. 4 is a bottom view of the ball cup of the present invention.

Shown in FIGS. 2, 3 and 4 is the unitary ball cup 10 of the present invention. The unitary ball cup 10 includes a receiving structure 12 for receiving a spherical game ball (not shown). The receiving structure, which extends to a flange 18, has a quarter-sphere shaped portion 14 and a channel shaped portion 16. One function of the receiving structure 12 is to receive the game ball so that the ball can be conveyed, or transferred, to the playing surface of the game table (not shown).

Flange 18 of the unitary ball cup rests flush against the outer surface of the side wall of the table game (not shown), once the ball cup is installed. One function of the flange 18 is to prevent the ball cup 10 from being forced entirely through the cutout hole in the side wall (not shown) toward the playing surface. The flange may have two openings 20, 22 to facilitate injection molding.

The unitary ball cup 10 further includes two resilient barbed tangs 24, 26. The barbed tangs 24, 26 may also be referred to as latches or hooks. The barbed tangs 24, 26 are sufficiently resilient to bend inward during installation and return outwardly to the normal position shown in FIGS. 2 and 3 once the barb reaches the inner surface of the side wall. The unitary ball cup 10 is installed by forcing it through the cutout hole until the flange 18 is flush against the outer surface of the side wall and the barb catches the inner surface of the side wall. One function of the barbed tangs 24, 26 is to releasably secure the ball cup 10 to the side wall. The ball cup 10 may be removed by forcing, or biasing, the barbed tangs 24, 26 inwardly until the barbs are released from the inner surface of the side wall. The ball cup 10 may then be removed from the game table by pulling the ball cup out from the side wall.

Optionally, the unitary ball cup 10 may include one or more annular sleeves 28, 30. Once installed, the sleeves 28, 30 rest flush against the surface of the cutout hole in the side wall of the game table. One function of the sleeves 28, 30 is to enhance aesthetics by covering the cutout hole. The lower sleeve 30 also functions to smoothly and efficiently transfer the game ball to the playing surface.

The unitary ball cup 10 may also include a key structure 32 adapted for a keyway (not shown) in the cutout hole. One function of the key structure 32 and keyway is to prevent the ball cup 10 from rotating within the cutout hole. Such rotation is undesirable because the receiving structure 12 should be level to the floor for optimum performance.

The unitary ball cup 10 may be manufactured by methods known in the art. Preferably, the unitary ball cup 10 is made by the injection molding of known thermoplastic or thermosetting materials. Most preferably, the ball cup 10 is made by injection molding high impact styrene.

Another aspect of the invention is a table soccer game including the combination of a table soccer table and the unitary ball cup 10. The table soccer table may be chosen from those already known in the art. For example, the table soccer table may be like that shown in the products catalog entitled "THE FUN BEGINS WITH RECREATIONAL PRODUCTS MFG. INC," as discussed above.

While preferred embodiments have been described, various modifications and substitutions may be made without departing from the spirit and scope of the invention. Accordingly, it is to be understood that the invention has been described by way of illustration and not limitation.

What I claim is:

1. A unitary ball cup for a table game comprising a means for receiving a spherical ball, a flange, and an integral, resilient latch for releasably securing the ball cup to the table game.

2. The ball cup of claim 1, wherein the means for receiving said spherical ball is quarter-spherical in shape.

3. The ball cup of claim 2, wherein the means for receiving further includes a channel shaped portion.

4. The ball cup of claim 2, wherein the flange has a circular shape.

5. The ball cup of claim 1 wherein the integral, resilient latch is selected from the group including an elongated, finger-like resilient latch, a hook, and a barbed tang.

6. The ball cup of claim 5, wherein the ball cup further comprises a means for preventing the ball cup from rotating when releasably secured to the table game.

7. The ball cup of claim 6, wherein the means for preventing the ball cup from rotating is a key adapted for a keyway.

8. The ball cup of claim 7, wherein the ball cup further comprises an annular sleeve.

9. The ball cup of claim 1, wherein the ball cup is injection-molded high impact styrene.

10. A table soccer game including the ball cup of claims 1 or 8.

11. A unitary ball cup for a table game comprising:

a quarter-sphere shaped cup;

a flange; and an integral, resilient finger-like device for releasably securing said ball cup to said table game.

12. The ball cup of claim 11, wherein the quarter-sphere shaped cup further includes a channel shaped portion.

13. The ball cup of claim 11, wherein the flange has a circular shape.

14. The ball cup of claim 11, wherein the ball cup further comprises a key, adapted for a keyway, that is capable of preventing the ball cup from rotating when secured to the table game.

15. The ball cup of claim 14, wherein the ball cup further comprises an annular sleeve.

16. The ball cup of claim 11, wherein the ball cup is made by injection molding.

17. The ball cup of claim 16, wherein the ball cup is injection-molded high impact styrene.

18. A table soccer game including the ball cup of claims 11 or 15.

19. A unitary ball cup for a table game comprising a means for receiving a spherical ball, a flange, and an element for releasably securing the ball cup to the table game, said element being selected from the group including a resilient latch, hook and barbed tang.

20. The ball cup of claim 19, wherein the ball cup further comprises a means for preventing the ball cup from rotating when releasably secured to the table game.

21. The ball cup of claim 20, wherein the means for preventing the ball cup from rotating is a key adapted for a keyway.

22. The ball cup of claim 21, wherein the ball cup further comprises an annular sleeve.

23. A table soccer game including the ball cup of claim 19.

24. A unitary ball cup for a table game comprising:

a quarter-sphere shaped cup;

a flange; and a resilient device for releasably securing said ball cup to said table game, wherein the ball cup further comprises a key, adapted for a keyway, that is capable of preventing the ball cup from rotating when secured to the table game.

25. The ball cup of claim 24, wherein the ball cup further comprises an annular sleeve.

26. A table soccer game including the ball cup of claim 25.

* * * * *